US005280762A

United States Patent [19]

Maillard

[11] Patent Number: 5,280,762

[45] Date of Patent: Jan. 25, 1994

[54] DEVICE FOR THE ARTICULATION OF THE SAIL IN HORIZONTAL AND IN VERTICAL DIRECTION, ASSOCIATED WITH A HOIST BLOCK, A DROP BLOCK AND A ROD SYSTEM

[76] Inventor: Michel Maillard, Ruette au Loup, Z.I. Sud, F-35440 Saint-Malo, Iran

[21] Appl. No.: 691,047

[22] PCT Filed: Oct. 26, 1990

[86] PCT No.: PCT/FR90/00778

§ 371 Date: Aug. 10, 1991

§ 102(e) Date: Aug. 10, 1991

[87] PCT Pub. No.: WO91/06469

PCT Pub. Date: May 16, 1991

[30] Foreign Application Priority Data

Oct. 26. 1989 [FR] France ..... 89 14246

[51] Int. Cl.[5] ..... B63H 9/06

[52] U.S. Cl. ..... 114/102; 114/90

[58] Field of Search ..... 114/102, 103, 39.1, 114/112, 90

[56] References Cited

U.S. PATENT DOCUMENTS

| | | | |
|---|---|---|---|
| 1,362,950 | 12/1920 | Ljungstrom | 114/103 |
| 1,516.063 | 11/1924 | Scammell | 114/103 |
| 4,006,701 | 2/1977 | Corbellini | 114/102 |
| 4,064.821 | 12/1977 | Roberts et al. | 114/102 |
| 4,388,888 | 6/1983 | Gushurst | 114/103 |
| 4,823.720 | 4/1989 | Foster | 114/103 |
| 5,012.755 | 5/1991 | Cockhart et al. | 114/103 |

*Primary Examiner*—Michael S. Huppert
*Assistant Examiner*—Thomas J. Brahan
*Attorney, Agent, or Firm*—Laff, Whitesel, Conte & Saret

[57] ABSTRACT

A hoist block is fixed on an inside edge of the sail and to articulated slide in order to enable a rotation in the axis of a sail boat mast groove. A drop block is on the outside edge of the sail. An associated tube or slat extends between the hoist and drop blocks in order to stiffen the sail profile. The block 2 or 9 is rigidly fixed on an articulated slider to hoist or lower the sail mechanism.

8 Claims, 3 Drawing Sheets

DEVICE FOR THE ARTICULATION OF THE SAIL IN HORIZONTAL AND IN VERTICAL DIRECTION, ASSOCIATED WITH A HOIST BLOCK, A DROP BLOCK AND A ROD SYSTEM

The present invention relates to the sailing field and more specifically to a complex sail adjustment device comprising a hoist block fixed on an articulated slide to enable a perfect rotation in the axis of the mast groove, and a drop or outside said edge block associated with a batten rod or slat that stiffens the sail profile.

The invention relates to a sailboat having a mast with a groove running along the length thereof. At least one "hoist" block slides vertically along the length of the groove. A sail is attached to the hoist block so that it raises and lowers as the hoist block moves up and down the groove. The outside edge of the sail (remote from the mast) is called the "drop edge" herein, reflecting the manner in which the outside edge may drop, droop, or flutter freely, as compared to the way that the mast edge of the sail is more or less held close to the mast. Hence, a "hoist" block is on the mast side and a "drop" block is on the opposite and unattached side of the sail.

Presently different processes exist to tauten a sail. In a first embodiment, the most commonly used means is to provide a flat slat to slide through a sleeve sewn on the sail, parallel to the boom. In another embodiment, there is a slat regulating system which is made up of boat slings, generally located on the dropping edge of the sail. It will be noted that in these two embodiments, the slats take their support from the hoist block of the sail, hindering its rotation on the mast groove at any time when the sail edge is changed.

The present invention makes it possible to orient the sail under all angles without being hindered by the tension of the slats on the mast groove. This is because a hoist block is rigidly affixed as one piece on an articulated slider. The drop block is located on the outside or drop edge of the sail and has a screw that makes it possible to compress and capture the rod or slat located between the two blocks.

Other characteristics of the invention will appear from the description that follows, taken with reference to the following drawings in which.

Figure 1:
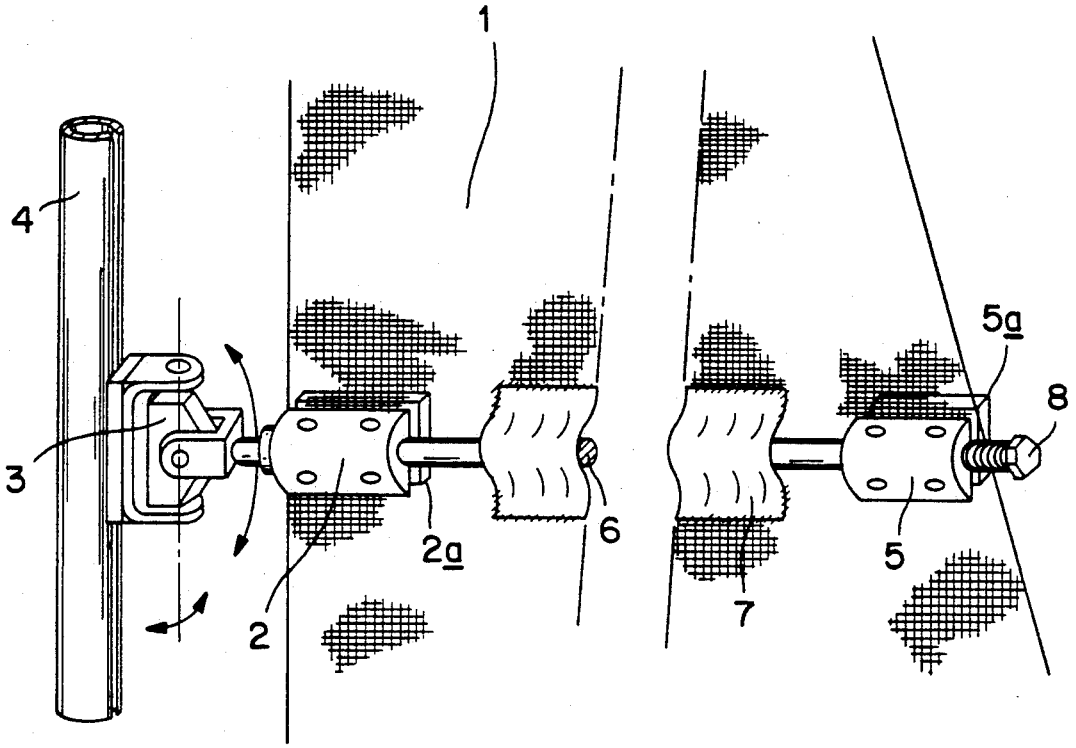
FIG. 1 is the representation of a rod system assembly.

According to the embodiment shown in FIG. 1 and according to the invention, the assembly that tauten the sail 1 is made up of a hoist block 2, fixed as one piece with an articulated slider 3, that slides inside the mast groove 4. The sail 1 of the hoist system is inserted between the two suitable plates or parts 2 and 2*a* which together form the hoist block. The outside or dropping edge of the sail 1 is inserted between the two suitable plates or parts of the dropping or lowering block 5 and 5*a*. Captured between the hoist block 2 and the drop block 5, the batten rod or slat 6 slides inside its cloth sleeve 7, sewn on sail 1, and parallel to the boom. A screw 8 is located in the drop block 5 and threaded into the shaft of batten rod or slat 6. By tightening screw 8, a pressure is exerted on the end of the batten rod or slat 6 that makes it possible to tauten sail 1 and to modify its profile. The two blocks 2 and 5 are fixed onto sail 1. The pressure exerted on batten rod or slat 6 is not transferred to slider 3. This makes it possible to complete a perfect rotation of the assembly around the two axes of the slider 3.

Figure 2:
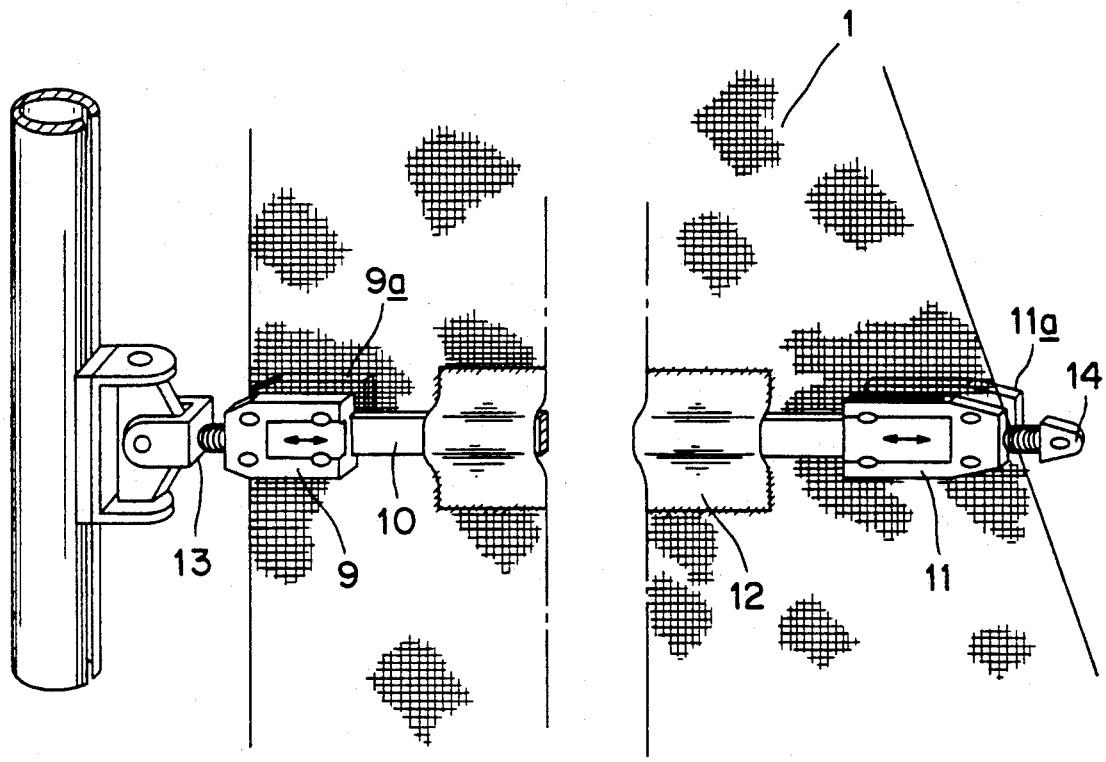
FIG. 2 is the representation of a slat system assembly.

According to the embodiment shown in FIG. 2, and according to the present invention, the sail 1 tautening assembly is made up of a hoist block 9, which receives one end of the slat 10, and of an outside or drop block 11 inside which the other end of batten rod or slat 10 slides. Batten rod or slat 10 slides inside a cloth sleeve 12 sewn parallel to the boom, on the sail 1. The hoist gear block 9 captures sail 1 between the two parts 9 and 9*a*. The outside or drop block 11 captures the outside edge of the sail between its two parts 11 and 11*a*. In part 9 of the hoist block and in the axis of batten rod or slat 10, there is located a screw 13 on which there is fixed the articulated slider in the mast groove, that makes it possible to exert a pressure on batten rod or slat 10. In the part 11 of the outside or drop block and in the axis of batten rod or slat 10, there is located a screw 14 that makes it possible to exert a pressure on the rod or slat 10. It suffices to tighten screw 14 of the outside or drop block 11 to exert a pressure on batten rod or slat 10 when the latter abuts against screw 13 of the hoist block 9 in order to tauten sail 1 and to obtain different profiles of the sail without any stress on the articulated slider of the mast groove.

Figure 3:
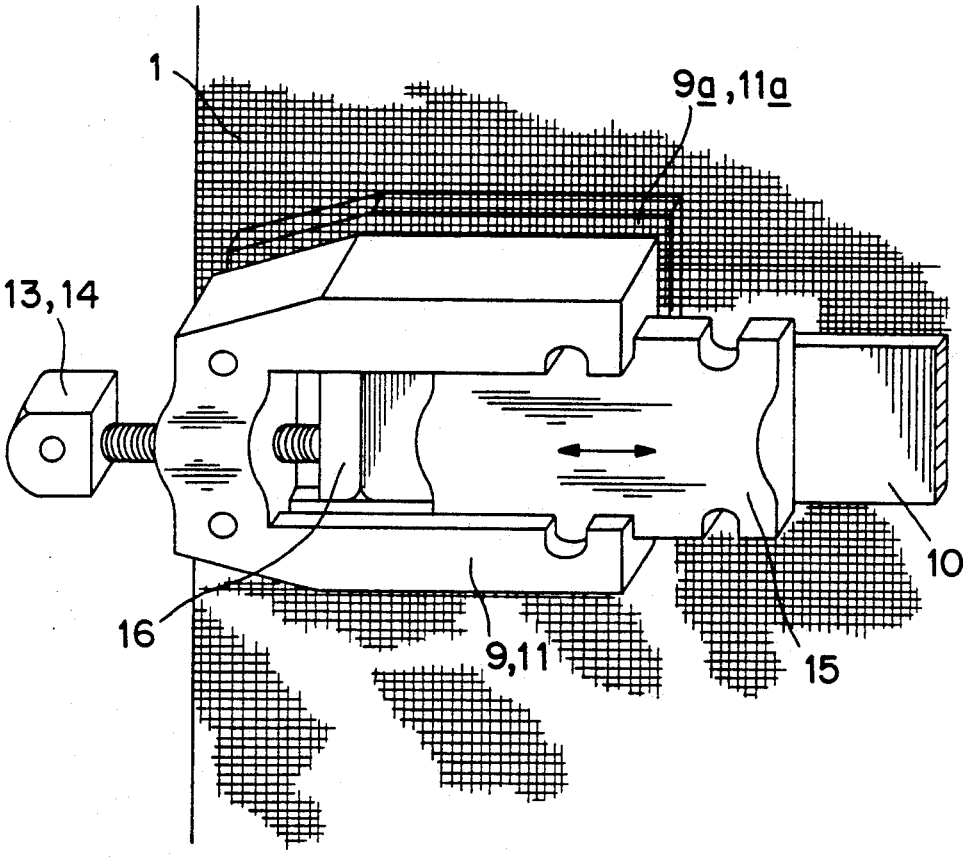
FIG. 3 is the representation of a slat system assembly.

According to the embodiment shown in FIG. 3 and according to the invention, the hoist block 9 and the outside drop block 11, respectively, receive the two ends of batten rod or slat 10. A sliding lid 15 makes possible the setting into place of rod or slat 10. (NOTE: the two blocks are the same; therefore, a single block is shown which is designated 9, 11). Sail 1 is inserted between the parts 9, 11 and 9*a*, 11*a* in order to allow a minimum run for the compression of batten rod or slat 10. Depending on its length, a shim 16 may be positioned between its end and the screw 13, 14, respectively.

According to the invention, the hoisting system 9 and the outside or drop block 11 remain attached to sail 1 despite the change (of position) or the removal of batten rod or slat 10, by means of its sliding lid 15 that can become completely disengaged. After the setting into place of the sliding lid 15, batten rod or slat 10 is imprisoned inside the casing while remaining free to slide. By tightening the screws 13, 14 in the two blocks 9, 11, a pressure is exerted on the batten rod or slat 10, this making it possible to tauten the sail by modifying its profile.

I claim:

1. A sail control mechanism for use with a mast having a groove for receiving a mechanism that slides therein as the sail is raised and lowered, said mechanism comprising a slider for riding in said groove, a hoist block pivotally attached to said slider for riding in said groove, one edge of said being attached to said hoist block, a drop block having two confronting plates clamped on opposite sides and to an opposite edge of said sail, a strip-like batten means extending through a sleeve in the sail between and attached to both said hoist block and said drop block, and means associated with at least one of said blocks for selectively compressing the batten between the hoist and drop blocks for adjusting the length of said batten and therefor the profile of the sail.

2. The mechanism of claim 1 wherein said means for selectively compressing sail batten means comprises a threaded member for selectively elongating or shortening a space between said hoist and drop blocks, said space being occupied by said batten, in order to fix the length thereof.

3. The mechanism of claim 2 wherein said threaded member is associated with the drop block end of said batten.

4. The mechanism of claim 2 wherein said threaded member is associated with the hoist block end of said batten.

5. The mechanism of claim 4 wherein there are two of said threaded members individually associated with opposite ends of said batten.

6. The mechanism of any one of the claims 1–4 wherein said hoist block is attached to said slider by a pivoting device having freedom to swing about orthogonally oriented axes.

7. The mechanism of either claim 4 or 5 and means associated with the hoist block for securely capturing said batten.

8. The mechanism of any one of the claims 1–5 for providing at least one shim at an end of said batten to adjust the length thereof.

* * * * *